United States Patent [19]

Mejia

[11] Patent Number: 4,680,582

[45] Date of Patent: Jul. 14, 1987

[54] INFORMATION REPORTING MULTIPLEX SYSTEM

[75] Inventor: Ezequiel Mejia, Longuevil, Canada

[73] Assignee: Honeywell Ltd., Scarborough, Canada

[21] Appl. No.: 265,478

[22] Filed: May 20, 1981

[30] Foreign Application Priority Data

Jul. 15, 1980 [CA] Canada ..... 356261

[51] Int. Cl.[4] ..... G08B 5/24

[52] U.S. Cl. ..... 340/825.17; 340/518; 340/514; 340/825.14; 340/825.2

[58] Field of Search ..... 340/825.17, 825.14, 340/518, 512, 825.13, 825.2, 514; 370/91; 455/58

[56] References Cited

U.S. PATENT DOCUMENTS

| | | | |
|---|---|---|---|
| 3,478,318 | 11/1969 | Rorholt | 340/825.36 |
| 3,713,142 | 1/1973 | Getchell | 340/512 |
| 3,735,353 | 5/1973 | Donovan et al. | 340/518 |
| 3,755,781 | 8/1973 | Haas et al. | 340/825.13 |
| 3,927,404 | 12/1975 | Cooper | 340/518 |
| 3,943,489 | 3/1976 | Brewster et al. | 340/825.26 |
| 4,067,008 | 1/1978 | Sprowls, III | 340/518 |
| 4,085,403 | 4/1978 | Meier et al. | 340/825.14 |
| 4,114,138 | 9/1978 | Demers | 340/825.65 |
| 4,114,141 | 9/1978 | Travis | 340/310 A |
| 4,162,488 | 7/1979 | Silverman et al. | 340/518 |
| 4,201,982 | 5/1980 | Humphries | 340/514 |
| 4,228,424 | 10/1980 | Lenay et al. | 340/518 |
| 4,352,201 | 9/1982 | Miller | 455/58 |

FOREIGN PATENT DOCUMENTS

| | | |
|---|---|---|
| 839424 | 4/1970 | Canada . |
| 973970 | 9/1975 | Canada . |
| 976278 | 10/1975 | Canada . |
| 982273 | 1/1976 | Canada . |
| 1005871 | 2/1977 | Canada . |

*Primary Examiner*—Donald J. Yusko

*Attorney, Agent, or Firm*—Donald J. Lenkszus

[57] ABSTRACT

An information reporting system is disclosed wherein a plurality of remote stations each receive synchronization signals from a master station, the synchronization signals initiating a timing mechanism in each remote station for dictating the time slot in which each remote station can transmit its information, each time slot occurring at a substantially different point in time, a master station having a synchronization generator for generating the synchronization signals and an indicator for indicating the information received from the remote stations, and a communication channel for interconnecting the remote stations and the master station.

28 Claims, 10 Drawing Figures

INFORMATION REPORTING MULTIPLEX SYSTEM

BACKGROUND OF THE INVENTION

This invention relates to a system for reporting alarm information from a plurality of remote stations to a master station and, more particularly, to a system wherein each remote station has a clock synchronized by the clock of the master station for providing a plurality of time slots after a synchronization signal is received and for determining which remote station should respond during which time slot and, also more particularly, to a system where the information reported by the remote stations is coded at the remote stations and decoded by the master station using code generators which are arranged in substantially the same manner at both the master station and the remote stations.

Data processing equipment, especially that which is designed for use in monitoring and controlling building air conditioning equipment and fire and security points within a building, is typically designed for monitoring a large number of input points. And when the sytsem is to be used to monitor such points spread throughout the building, it is too expensive for such systems to rely upon multiconductor cables used in typical computer systems for interconnecting the computer with its peripheral equipment. Typical in building control and monitoring systems, the central station or computer is connected over a coax cable to its plurality of remote stations. Thus, there is no dedicated wiring to each remote station which can be used to construct the time sequence in which the remote stations report their information to the central station and thereby avoid the situation where two or more remote stations attempt to communicate with the central station at the same To avoid the simultaneous transmission of information by two or more remote stations, the prior art has relied upon various techniques. In one technique, the central station polls the remote stations in sequence and requests the reporting of information. The central station will not poll the next station until it has received the information from the previous station. Since a remote station cannot respond or report information to the central station until it has been polled, there is little danger that multiple remote stations will attempt to transmit at the same time. However, the time required for the central station to send out as many poll messages as there are remote stations can be prohibitive. Therefore, systems have been devised for allowing the central station to transmit one global polling message which then causes the remote stations to transmit their information in sequence on a priority basis; that is, the second station will not report its information until the first station has finished reporting.

The drawback to this type of system is that if prior stations have large amounts of information to transmit to the central station, subsequent stations have to wait long periods of time for transmitting what little bit of information they may have. To avoid this problem, time multiplexing systems provide time slots having a fixed duration so that prior remote stations will not unnecessarily delay the transmission of information by subsequent stations. Thus, if prior stations have more information to transmit than can be transmitted within their time slot, they must wait for their subsequent time slots in which to transmit the rest of their information. However, all of these systems are more suited to large scale application. The present system is useful in those buildings where only a limited number of points need to be monitored.

SUMMARY OF THE INVENTION

The invention relates to a system for reporting information having a plurality of remote stations each connected to at least one sensor and having a synchronization terminal for receiving periodic synchronization signals from a master station, a time slot generator connected to the synchronization terminal for supplying an enabling signal at a predetermined amount of time after receiving each synchronization signal wherein the time slot for each station occurs at a substantially different time, a data terminal, and a transmit circuit connected to the time slot generator and to the sensor for supplying information derived from the sensor to the data terminal upon receiving the enabling signal, the system further having a master station having a synchronization generator, a synchronization terminal connected to the synchronization generator for recieving synchronization signals therefrom, a data terminal, and an information receiver connected to the data terminal of the master station for receiving the information supplied by the plurality of remote stations, the system further having a communication line for interconnecting the data terminals and the synchronization terminals of the amster station and the plurality of remote stations.

The invention also relates to a communication system for transmitting information including at least one remote station having a data terminal, a transmission circuit connected to the data terminal and to at least one sensor for transmitting information derived from the sensor to the data terminal, and an encoding circuit connected to the transmission circuit for encoding the information, the encoding circuit having a code generator, the system further including a master station having a data terminal for receiving the information from the at least one remote station, a decoding circuit connected to the data terminal and having an output, a code generator connected to the decoding circuit and arranged for providing a code compatible with the code as supplied by the code generator of the remote station so that the information supplied by the sensor and encoded at the remote station will be decoded by the master station so that the information can be derived from the encoded information transmitted from the remote station, and an information receiver connected to the decoding circuit output for receiving the information, the system further having a communication line for interconnecting the data terminals of the at least one remote station and the master station.

BRIEF DESCRIPTION OF THE DRAWINGS

These and other features and advantages will become more apparent from a detailed consideration of the invention when taken in conjunction of the drawings in which.

DETAILED DESCRIPTION

Figure 1:
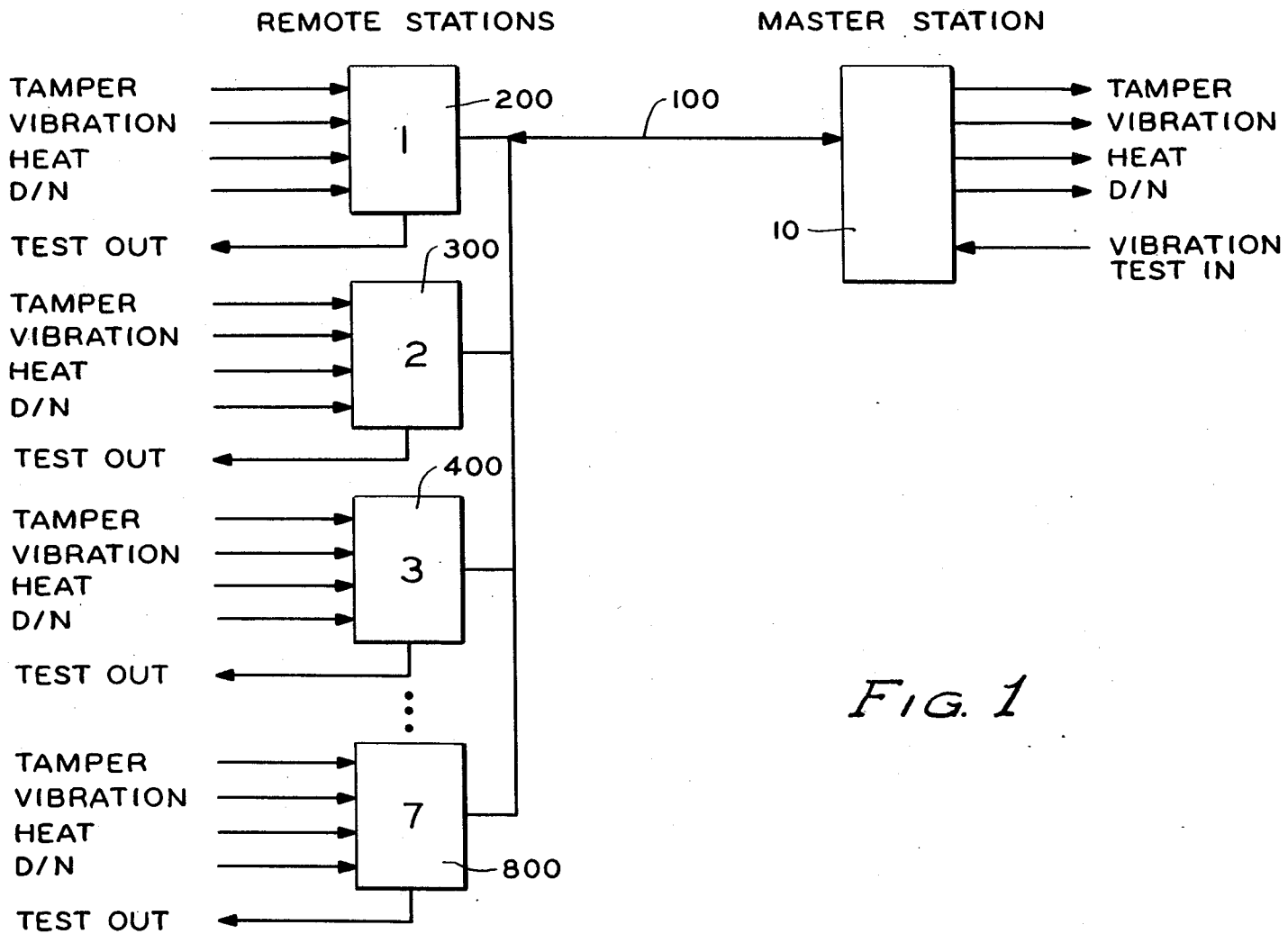
FIG. 1 is a generalized block diagram of the invention.

In FIG. 1, master station 10 is connected over communication cable 100 to a plurality of remote stations 200, 300, 400 . . . 800 with, in the example shown in FIG. 1, the maximum number of remote stations being 7. Master station 10 has a number of outputs indicated as tamper, vibration, heat and day/night and an input for testing the vibration sensors of the various remote stations. Master station 10 communicates with remote stations 200–800 over cable 100 bidirectionally for receiving the data supplied by the sensors connected to each remote station and for transmitting the vibration test signal and the synchronization signals to the remote stations. All remote stations are identical, except for the counter which determines the time slot in which they report and, therefore, only remote station 200 will be discussed in any detail. Remote station 200 is capable of being connected in the illustration shown to a maximum of four sensors, one of which may be a tamper sensor, one of which may be a vibration sensor, one of which may be a heat sensor and one of which may be a day/-night switch. Moreover, remote station 200 has an output to indicate that the remote station is under a vibration test.

As illustrated in FIG. 1, the sensors have been chosen for protecting bank vaults or safes where the tamper input signal may be derived from a tamper switch located to sense any tampering of the alarm detection apparatus associated with the vault or safe, the vibration input may be derived from a sensor which senses vibrations or shocks delivered to the safe by a drilling operation or explosives, the heat input may be derived from a heat sensor which is acitvated whenever, for example, a welding torch is used on the protected device, and a day/night switch is included in combination with a door switch such that any operation of the door of the vault or safe during the night time hours will trigger an alarm whereas such normal operation during the day will not.

The communication cable 100 can be essentially a four line cable, one line transmitting data between the master station and remote stations, one line transmitting the synchronization signals from master station 10 to the remote stations, one line supplying power to both the master station and the remote stations and one line acting as ground for both the master station and the remote stations.

Figure 2:
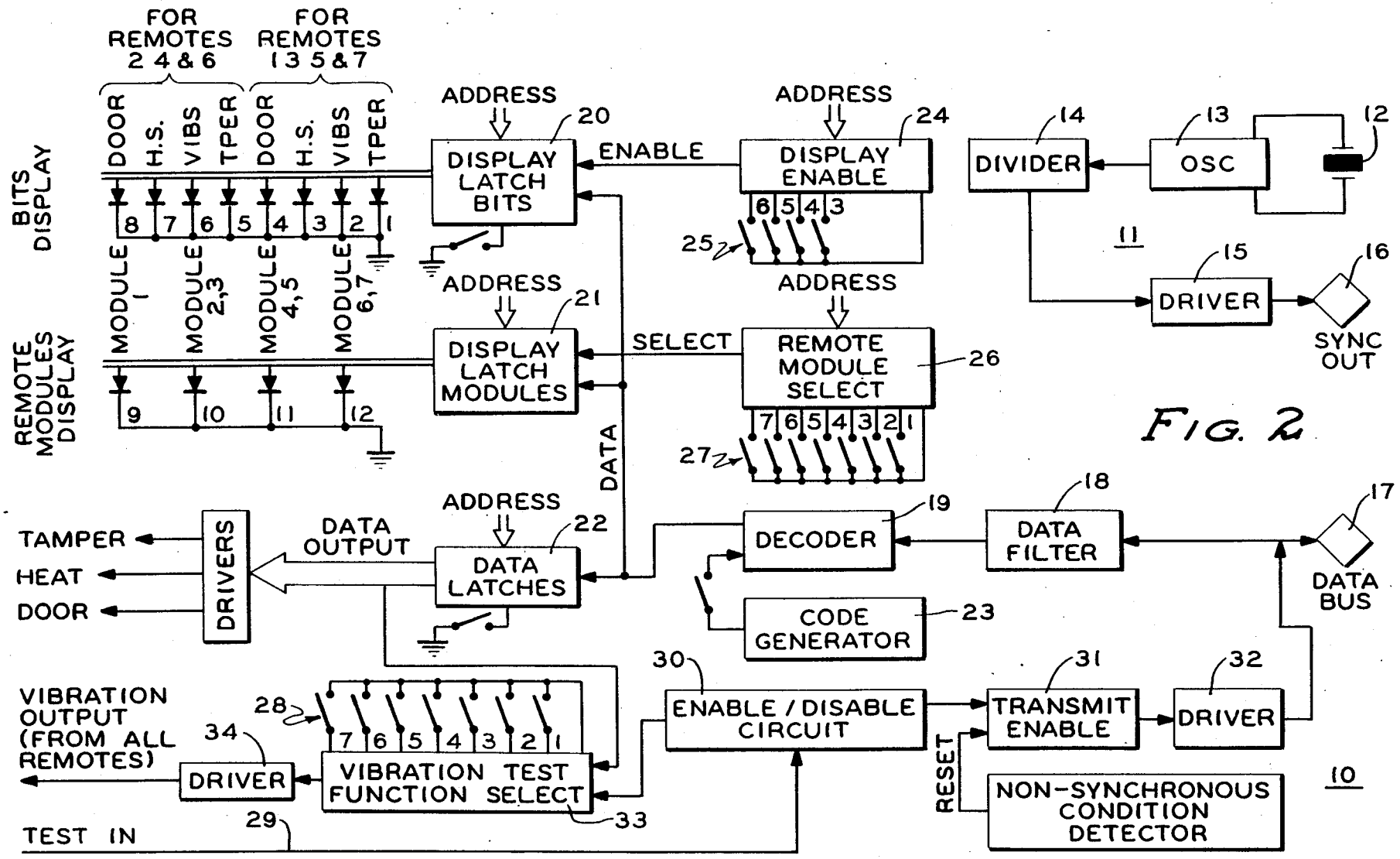
FIG. 2 is a block diagram of the master station.
Figure 6:
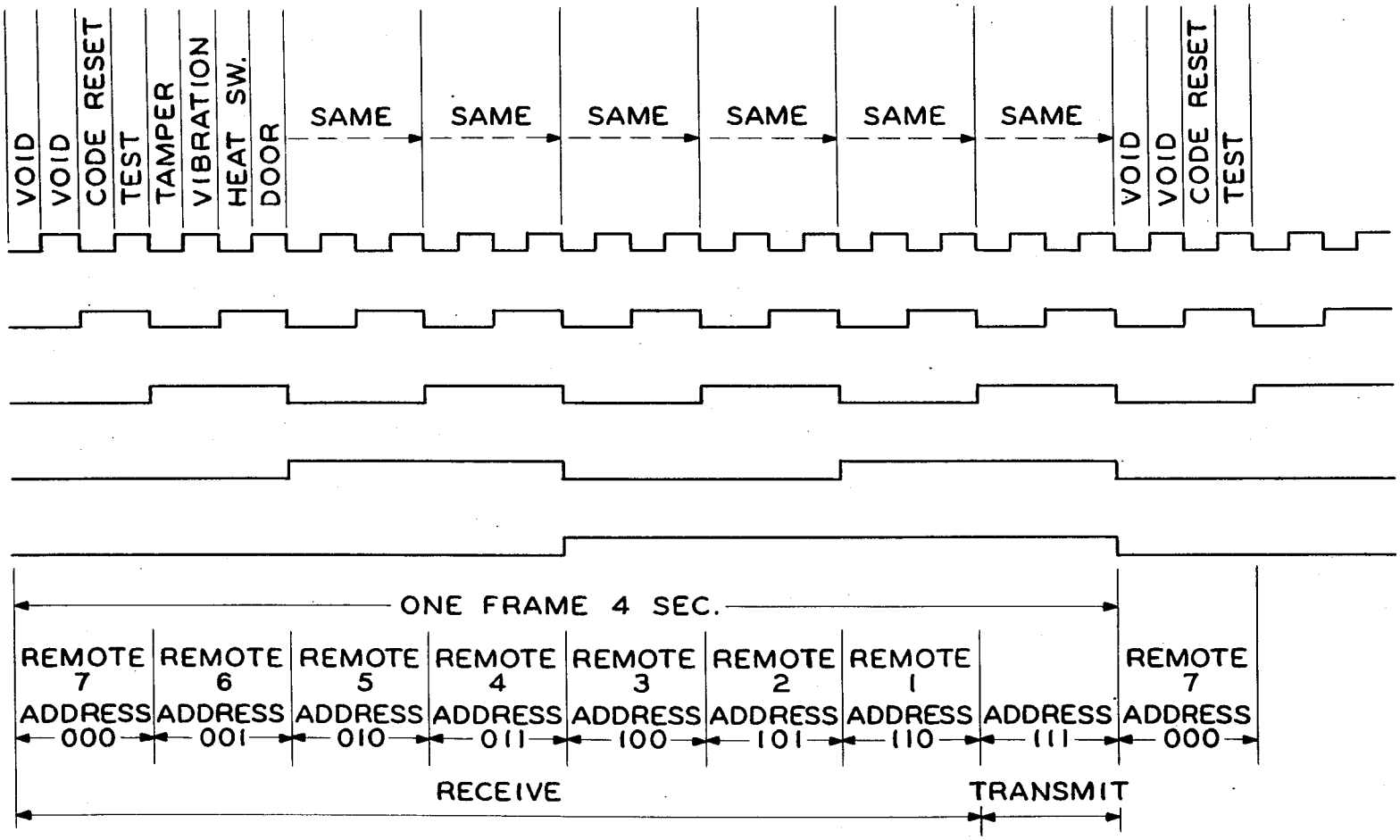

The master station is shown in block diagram form in FIG. 2. Master station 10 includes synchronous signal generator 11 which is comprised of crystal 12 and oscillator 13 for supplying pulses to divider 14. The pulses from divider 14 are supplied through driver 15 to synchronization terminal 16 for supply to the remote stations. In addition, divider 14 also supplies the ADDRESS input to the various circuits as shown in FIG. 2 and shown in more detail in FIGS. 3A–3D. As viewed in FIG. 6, synchronization signal generator 11 generates a sync pulse on the sync output terminal 16 once every four seconds. Divider 14 then addresses the various display latches and select circuits creating 8 time slots, 7 of which are provided for the corresponding 7 remote stations and 1 of which is provided for transmitting data from the master station to the remote stations. At the end of the 8 time slots, another synchronization pulse is supplied at terminal 16.

The information from the remote stations is received at data terminal 17, filtered by filter 18 and decoded at 19 before it is supplied to the bit display latch 20, the module display latch 21 and data latches 22. The information at the remote stations is encoded by a code generator located thereat and is decoded by decoder 19 which has an input from code generator 23. Code generator 23 is arranged to provide a code compatible with the code as supplied by the code generator at the remote station so that the information can be properly derived from the transmission from the remote station to the master station.

Each of the latches 20, 21 and 22 is addressed by divider 14. In addition, bits display latch 20 receives a further input from the display enable circuit 24 which has an input from divider 14 and has further inputs from switch bank 25. The arrangement shown in the drawings can accommodate up to 7 remote stations, but not all 7 remote stations need to be connected into the system for correct operation. When remote station 1 is connected, switch 6 is closed, when remote stations 2 and 3 are connected, switch 5 is closed. When remote stations 4 and 5 are connected, switch 4 is closed. When remote stations 6 and 7 are included, switch 3 is closed. These switches provide display enable only.

Likewise, module display latch 21 receives a further input from remote module select circuit 26 which receives inputs from divider 14 and from switch bank 27. Each switch is closed when the corresponding remote station is connected to the communcation bus. Similarly, each switch in switch bank 28 is operated when its corresponding remote station is connected to the bus The master station in FIG. 2 is capable of providing a vibration test for each of the remote stations. When a vibration test is to be conducted, a negative going pulse is supplied to line 29 which operates the enable/disable circuit 30 to accomplish two functions. First, circuit 30 operates transmit enable circuit 31 to supply a pulse through driver 32 to the data terminal 17 for communication to the remote stations in order to begin the vibration test. Circuit 30 also conditions vibration test function selector circuit 33 to receive the information returned from the remote stations through data latch 22 to provide the necessary vibration output through driver 34.

Bits display latch 20 and module display latch 21 cooperates with the LEDs shown connected to their outputs for indicating the various alarm conditions that can occur at the remote stations. Each latch is also addressed so that the proper signal from a remote station results in the energization of a pair of LEDs to designate the specific alarm condition which has occurred and the specific module where the alarm has arisen, i.e. the latches are addressed to synchronize the display LEDs to the incoming data as supplied by the appropriate switches at the appropriate remote stations. Instead of providing an LED for each type of sensor at each remote station which would require a total of 28 LEDs, the LEDs shown in FIG. 2 are grouped to reduce the number of LEDs. For example, if a tamper alarm has occurred at remote station 4, latches 20 and 21 in response to the address inputs received from divider 14 and the data inputs received from data terminal 17 will cause LED 5 in the bits display and LED 10 in the remote module display to light. If, however, a tamper alarm signal comes from remote station 6, LED 5 will still light, but LED 12 (instead of LED 10) will light indicating that the tamper alarm originated at remote station 6 instead of remote station 4.

The details of the block diagram shown in FIG. 2 are shown in FIGS. 3A–3D. The circled terminals show the way in which FIGS. 3A–3D are interconnected. The same reference numerals are used in FIGS. 3A–3D as are used in FIG. 2 to designate similar structures.

Figure 3A:
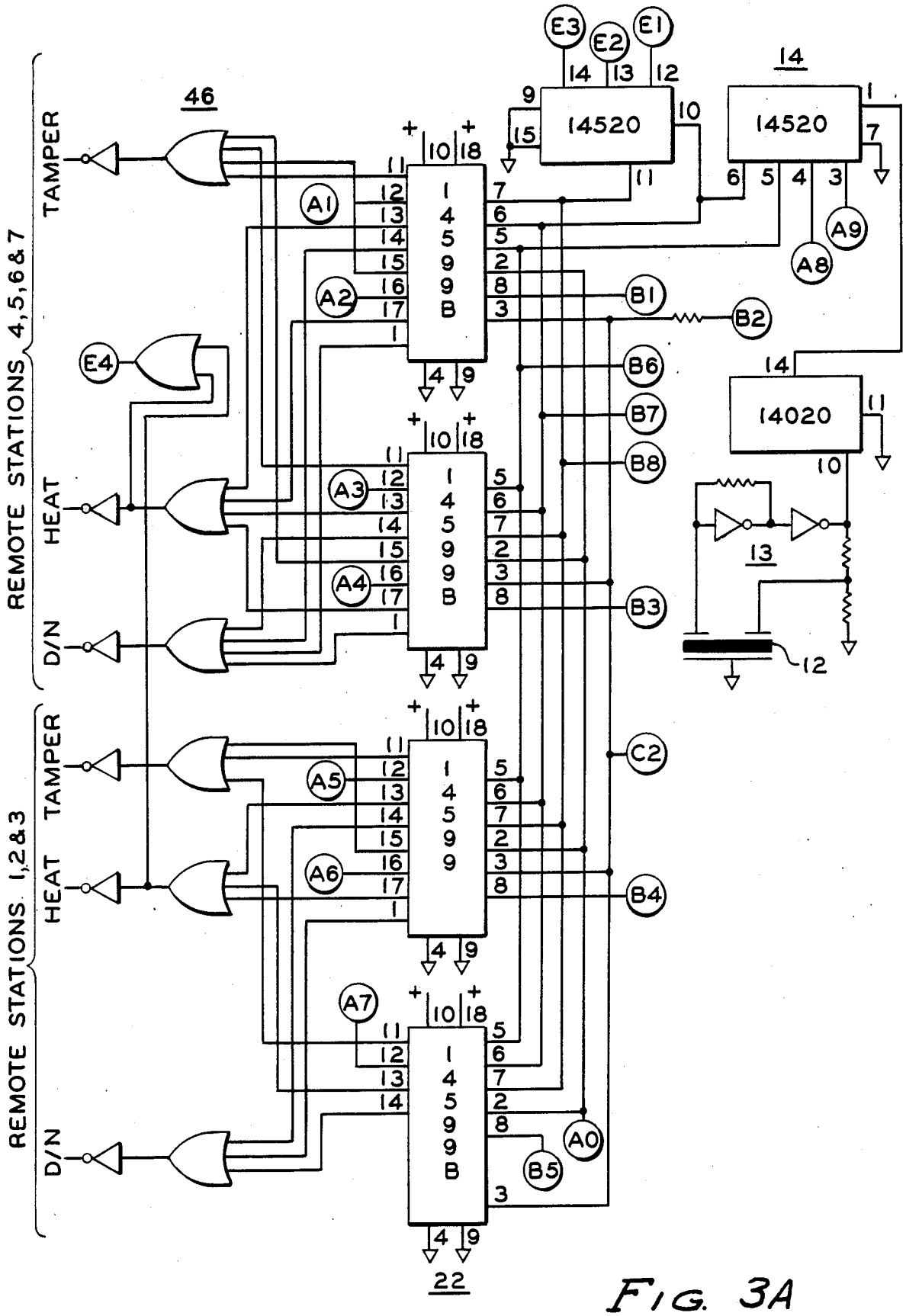
FIGS. 3A–3D illustrate a detailed circuit schematic for the block diagram of FIG. 2.
Figure 3B:
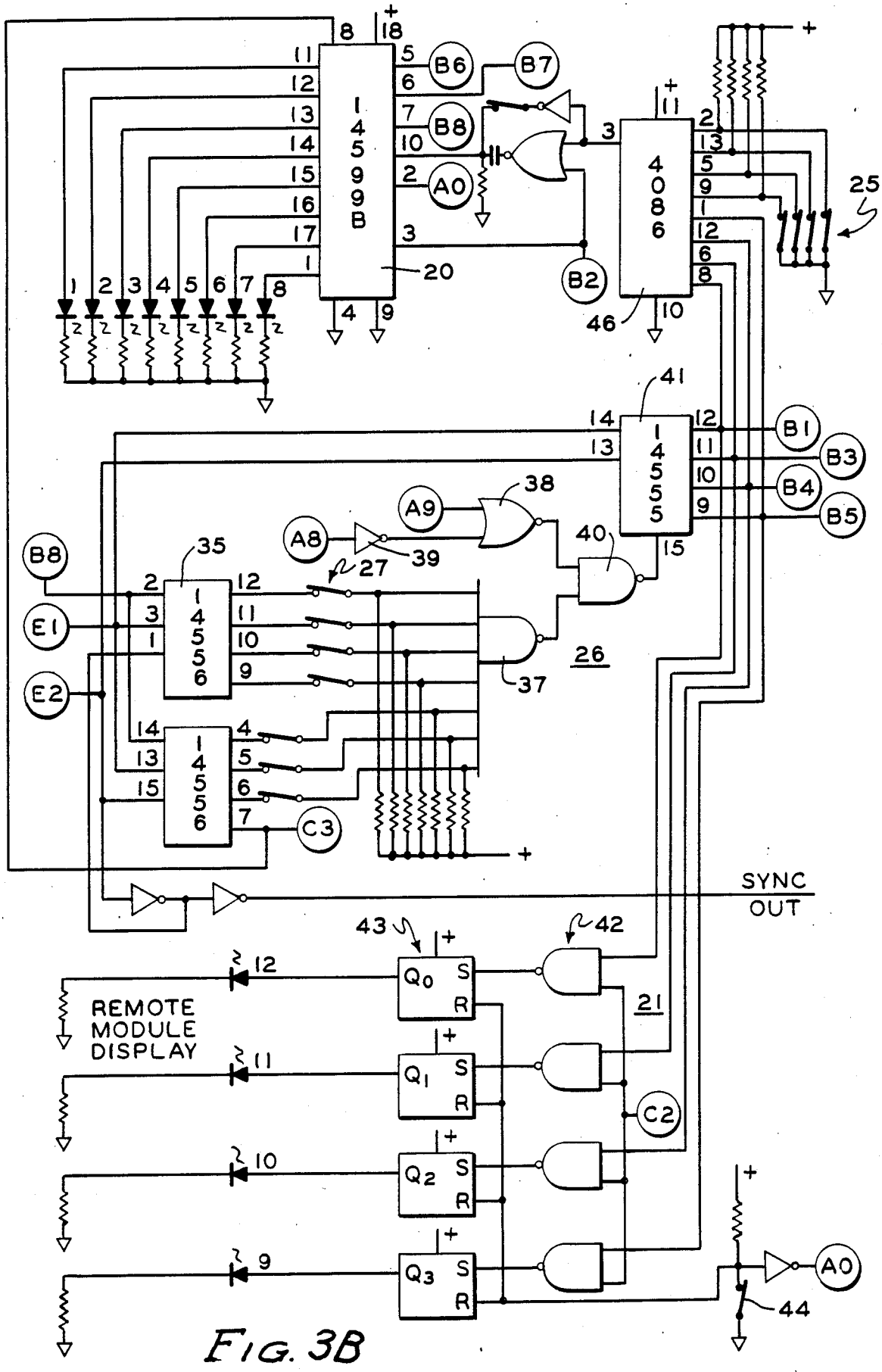

In FIG. 3A, the output from oscillator 13 is divided by divider 14 which has anumber of outputs. Three of the outputs are decoded by decoders 35 and 36 in FIG. 3B for determining which of the remote module display LEDs will be lighted at any point in time, i.e. to synchronize the LEDs to the time slots. Switch bank 27 connected between the outputs of decoders 35 and 36 and the input of NAND gate 37 determine which remote stations are connected to communication cable 100. Two other outputs of divider 14 are decoded by NOR gate 38 and inverter 39 for providing a strobe pulse to the input of NAND gate 40 which operates in conjunction with NAND gate 37 to control the enable terminal of decoder 41. Decoder 41 also decodes the outputs E1 and E2 of divider 14 for supplying pulses at its output. However, a pulse will not be provided at one of the outputs if a corresponding switch in switch bank 27 is open.

The outputs from decoder 41 perform a number of functions. First, they determine which module display LED will be lighted when a corresponding input is received over data terminal C2 in an appropriate time slot. To accomplish this function, the outputs of decoder 41 are connected through NAND gates 42 the outputs of which are connected to the set terminals of corresponding R-S flip-flops 43 which control the remote module display LEDs. R-S flip-flops 43 are reset by switch 44. The outputs of decoder 41 are also used as inputs to decoder 46 which receives further inputs from switch bank 25 for disabling display latch 20 whenever a specific remote station is not connected to communication cable 100. If a corresponding switch 25 is closed, then decoder 20 is enabled by decoder 36. Latch 20 decodes corresponding output lines from counter 14 through terminals B6, B7 and B8 to ensure that the correct LED is energized in the correct time slot if an alarm is received in that time slot from a remote station which is connected to the communication bus 100 and is arranged to provide its information within that specified time slot.

Figure 3C:
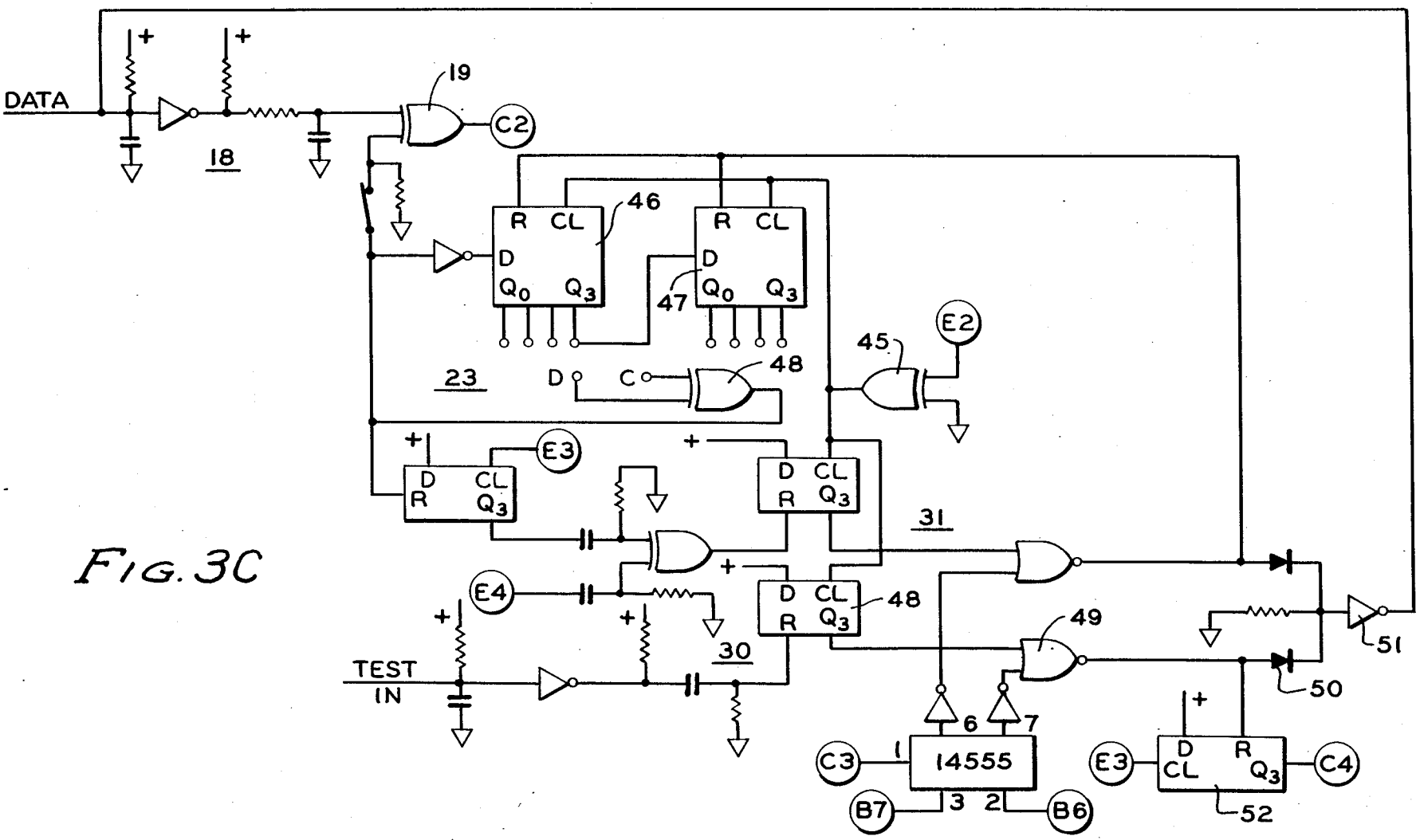

The data which is received over the data input terminal shown in FIG. 3C is connected through EXCLUSIVE OR gate 19 and over terminal C2 to a corresponding terminal to FIG. 3A as an input to data latch array 22 and through terminal B2 as an input to decoder 20. Each latch in the data latch array has corresponding inputs from divider 14 so that each latch is addressed in its specific time slot to latch in the data bits which are received in the appropriate time slot from the remote station. Thus, the outputs of these latches will provide the alarm information synchronized to the specific remote stations as shown in FIG. 3A. As shown, the latched outputs from latch array 22 are decoded by OR gate array 46 to provide 6 outputs the top 3 (tamper, heat, D/N) of which relate to remote stations 4–7 and the bottom 3 (tamper, heat, D/N) of which relate to remote stations 1–3. Thus, not only is the information derived from the remote stations displayed on LEDs, but alarm output pulses are provided as shown in FIG. 3A for processing by whatever output apparatus may be connected to these output lines.

As shown in FIG. 3C, EXCLUSIVE OR gate 19 is the decoder 19 shown in FIG. 2. One input to EXCLUSIVE OR gate 19 is derived through filter 18 from the data terminal as the master station and the other input to decoder 19 is derived from code generator 23. Code generator 23 is comprised of EXCLUSIVE OR gate 45 which connects terminal E2 from counter 14 to the clock terminals of counters 46 and 47. EXCLUSIVE OR gate 48 has a pair of inputs which can be connected to various outputs of counters 46–47 to determine the particualr code which is being used at the master station for encoding a decoding the information. Thus, the output of EXCLUSIVE OR gate 48 is connected back to the other input of EXCLUSIVE OR gate-decoder 19.

Figure 3D:
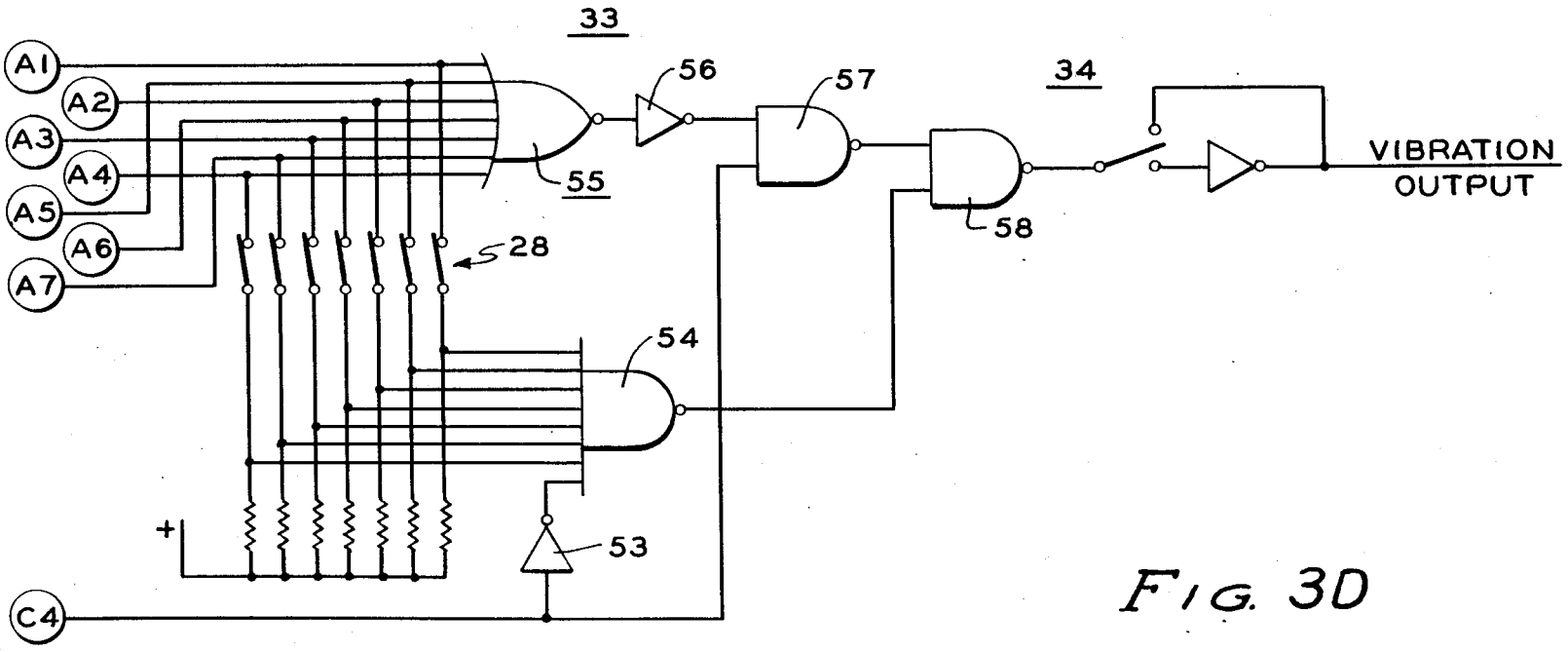

The remaining circuitry shown in FIGS. 3C and 3D is concerned with providing the vibration test. When a test is to be conducted, the TEST IN line is pulsed low which resets counter 48 so that it can again begin counting address pulses received over terminal E2. When counter 48 counts out, it supplies an output pulse through NOR gate 49, diode 50 and inverter 51 to the data terminal which is then supplied to the remote stations instructing them to conduct a vibration test. At the same time, counter 52 is reset which, through inverter 53 of FIG. 3D, enables NAND gate 54.

Moreover, NOR gate 55 has a plurality of inputs connected to certain outputs of latch array 22 as shown. At the time the vibration test pulse is supplied to the remote stations, the outputs of these latches are low which means that the output from NOR gate 55 is high and the output from inverter 56 is low which disables NAND gate 57. Moreover, as long as all of the outputs of latches 22 are low, the output of NAND gate 54 is correspondingly high which enables NAND gate 58.

When the vibration test is conducted at the remote stations, if operation at the remote stations is proper a pulse will be received for each remote station. As the pulse is clocked into the latches 22, the corresponding output for that remote station will be high. If all remote stations have been properly tested, all of the inputs to NAND gate 54 will eventually go high which will drive its output low. Since during this test the output of counter 52 is low, NAND gate 57 must therefore have a high output. The high output from NAND gate 57 will enable NAND gate 58 to pass the output from NAND gate 54 to the vibration output terminal. Thus, when all remote stations have properly conducted their vibration test and have transmitted their information to latches 22, all inputs to NAND gate 54 will be high which will cause its output to go low. This low output will drive the output from NAND gate 58 high which, when the switch shown at the output of NAND gate 58 is in its lower position, will be inverted to provide a low output pulse indicating that the remote stations supplied the vibration alarms as intended.

If one of the remote stations had not properly responded during the test, one of the inputs to NAND gate 54 would not have gone high which would have kept its output high and prevented any pulse from going through NAND gate 58.

Moreover, if for example remote station 4 had not been connected to the communication cable 100, the corresponding switch in switch bank 28 must be opened so that the corresponding input to NAND gate 54 remains high during the test. Otherwise, the input would always remain low and the output from NAND gate 54 would never change.

At the end of the test, counter 52 receives an input from divider 14 for blocking any further tests to be conducted. Furthermore, the switch connected between the vibration output and NAND gate 58 is an optional feature so that when it is against its lower terminal a low pulse indicates an alarm and when the switch is against its upper terminal a high pulse indicates alarm.

Figure 4:
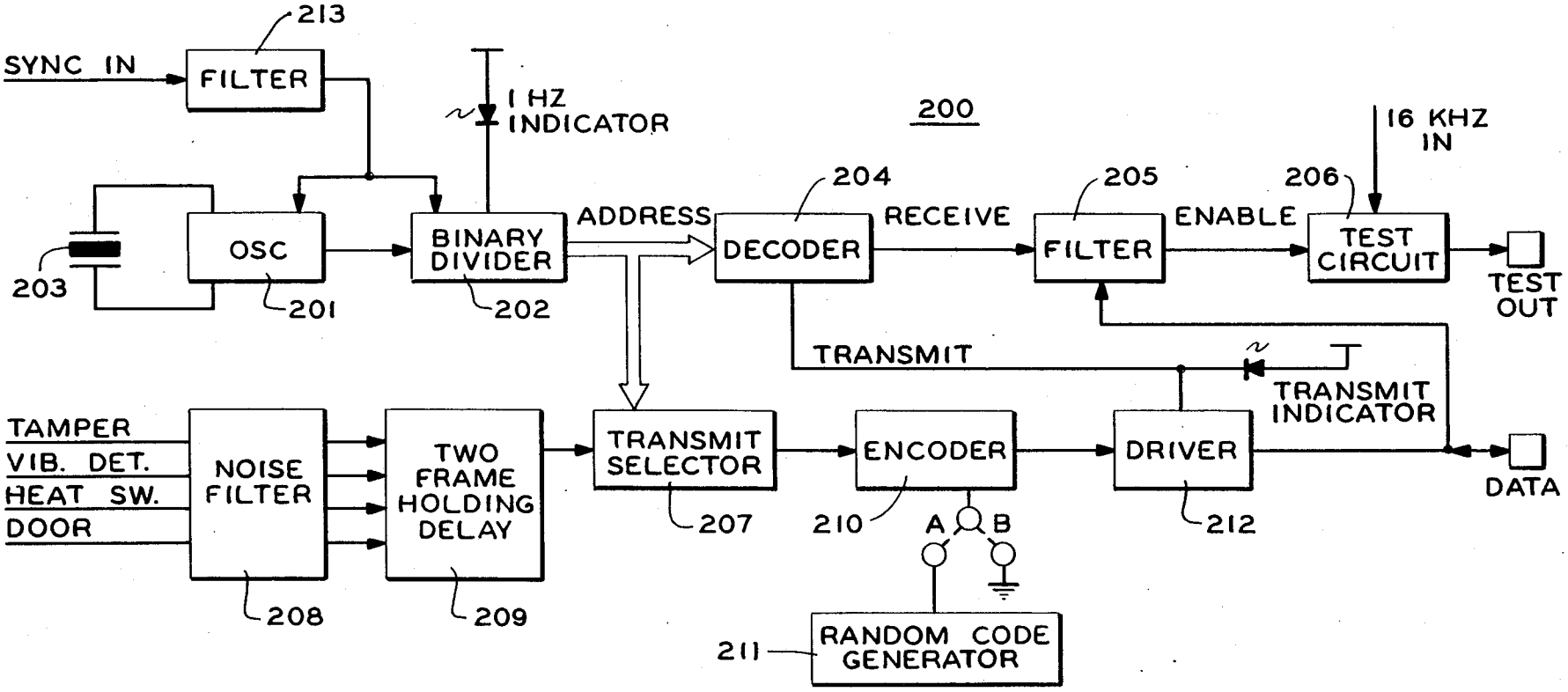
FIG. 4 is a block diagram of a remote station.

Remote station 200 is shown in block diagram form in FIG. 4. A new reporting sequence is started each time a sync signal is received over the SYNC IN terminal as shown in FIG. 4. Each remote station, after the receipt of a sync pulse, begins a counting sequence for chopping the four second time period between sync pulses into time slots. By properly connecting the outputs of the counter to the transmission control networks, each remote station is made to respond during a different time slot.

Thus, the remote station shown in FIG. 4 comprises a SYNC IN terminal for receiving the synchronization pulse which is then filtered by filter 213 and used to reset oscillator 201 and divider 202. Oscillator 201 is driven by crystal 203 for providing the clock signals to divider 202. The output of dividing 202 is an ADDRESS signal which is used by decoder 204 to determine whether or not the remote station should be in a receive mode or in a transmit mode. In the receive mode, the output from decoder 204 is filtered at 205 and enables test circuit 206 to supply the 16KHz signal to the TEST OUT terminal which is received as an input at terminal 7 of the vibration detector and eventually supplied through the circuit to the data terminal of the remote station 200.

The ADDRESS signal is also used to enable transmit selector 207 which transmits the information from the four input terminals 5-8 which are connected to the four sensors having the indicated functions to the DATA terminal. The four sensors connected to terminals 5, 6, 7 and 8 are likewise connected to noise filter 208 and then to delay circuit 209. The output from circuit 209 is connected to the input of transmit selector 207 the output of which is connected to encoder 210. Encoder 210 uses random code generator 211 for encoding the information derived from the sensors to be transmitted to the master station. Code generator 211 is arranged to provide a code compatible with the code as supplied by the code generator of the master station so that the information encoded by the remote station is decoded by the master station to produce the original information. This encoded information is then supplied through driver 212 to the DATA terminal.

Figure 5A:
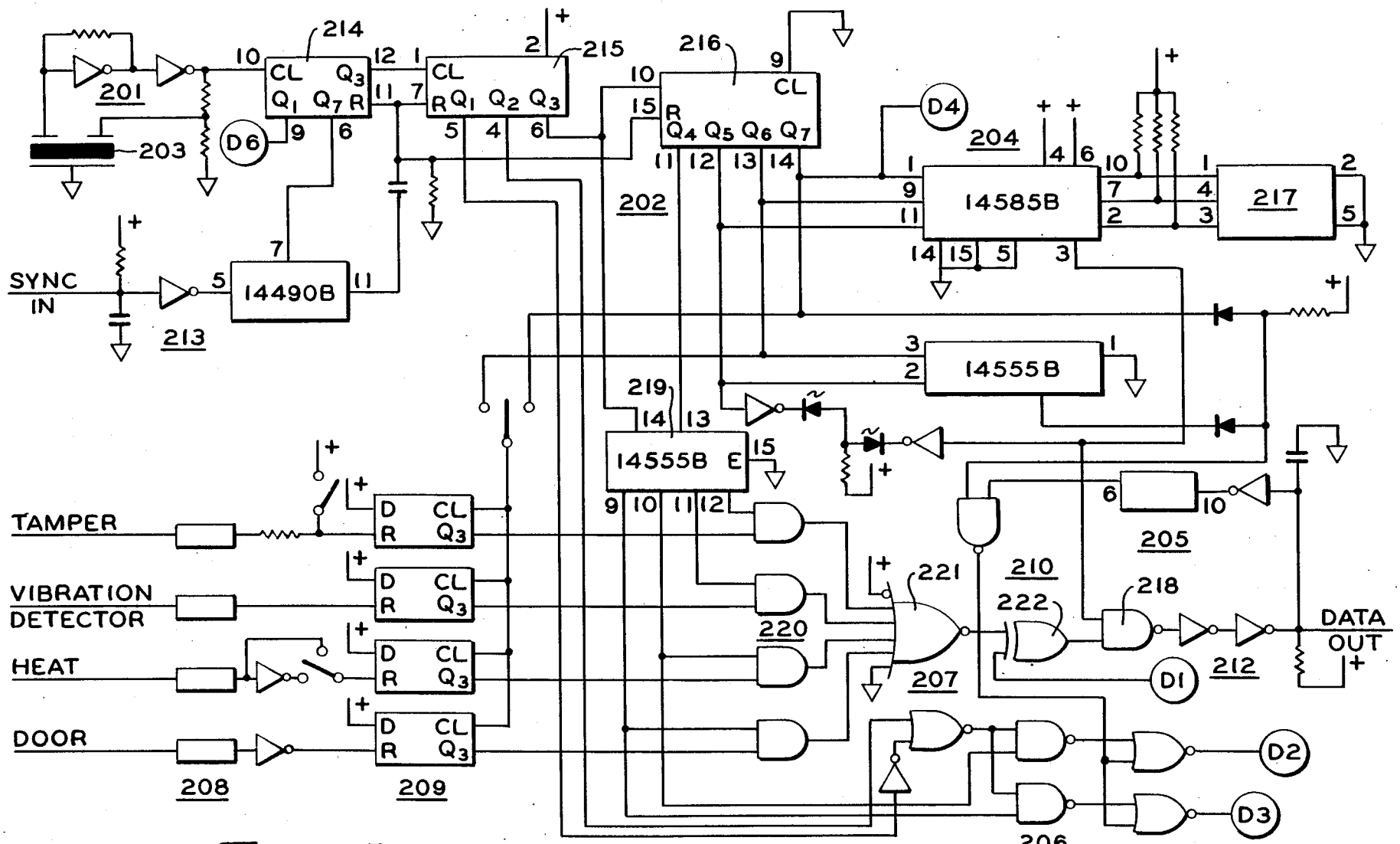
FIGS. 5A and 5B illustrate a detailed circuit schematic for the remote station of FIG. 4; and, FIG. 6 is a timing diagram of the invention.
Figure 5B:
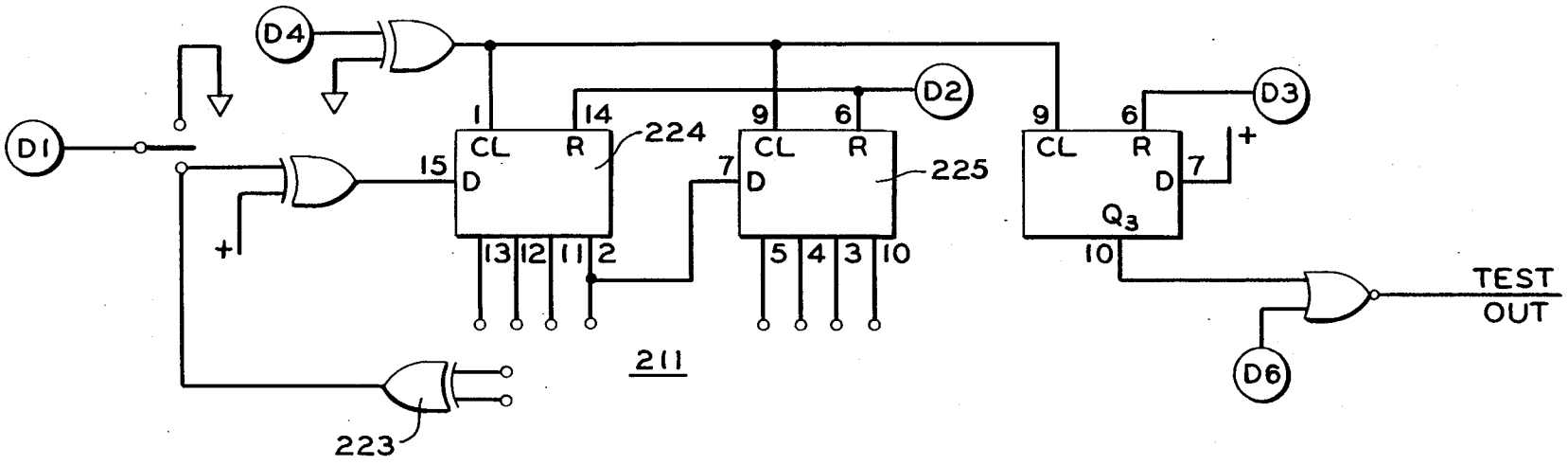

The details of remote station 200 are shown in FIGS. 5A and 5B. As shown in these circuits, the synchronization signal is received and filtered at 213 before it is used to reset the oscillator 201 and the counter/divider 202. The oscillator 201 is connected to crystal 203 and comprises a pair of inverters, with resistors connected as shown, as well as divider 214. Counter 202 is comprised of dividers 215 and 216 which divide down the oscillator signal and provide the various outputs as shown. The Q outputs of divider 202 provide the address codes and are connected both to the transmit selector 207 and to the decoder 204. Decoder 204 has a further input from switch 217 for decoding the address received from divider 202 and for providing an output to NAND gate 218 of driver 212 for controlling the transmission of data to the DATA OUT terminal.

Transmit selector 207 is comprised of decoder 219, NAND gate array 220 and NOR gate 221 for decoding the output from divider 202 to determine whether or not a transmission should take place and for converting the parallel input information into a serial output. If the information supplied by the sensors connected to the remote station should take place, then the various inputs are filtered by filter array 208, delayed by counters 209 and then supplied to NAND gate array 220 which converts this parallel information from the alarm switches to serial information through NOR gate 207 for supplying one input to encoder 210. Encoder 210 in the form of EXCLUSIVE OR gate 222 receives its other input from code generator 211 shown in FIG. 5B.

This code generator is comprised of the same form of circuit as that shown with respect to the master station. The inputs to EXCLUSIVE OR gate 223 are connected to counters 224 and 225 of the code generator 211 so that the codes generated by the code generators of the master station and the remote station result in the proper display of the alarm information generated by the sensors at the remote station. Thus, the output of code generator 211 is connected over terminal D1 to the input of EXCLUSIVE OR gate 222 for encoding the data supplied by the alarm switches. When decoder 204 has conditioned NAND gate 218 to pass this information, the information is supplied through the inverters to the DATA terminal as shown.

Information received over the data line from the master station is filtered at 205 and used to control the test circuit 206 which will supply a clock signal as derived from counter 202 to a TEST OUT terminal as shown. This oscillating signal is then connected through the circuit to the data terminal for supply to the master station and for operation thereon as previously described.

Thus, each remote station has a crystal 203 and an oscillator 201 which operates in conjunction with as oscillator at the master station for beginning a timing operation which determines the time slot in which each individual remote station reports and the segment within each time slot for transmitting each of the 1 to 4 sensors which may be connected to the remote station. The oscillator/divider also provides the timing function for converting the parallel information derived from the alarm switches into a serial transmission within the time slot to transmit any alarm information to the master station. The master station operates upon this serial data to display the data and to supply the data to whatever data processing equipment may be connected to its output terminals.

The embodiments of the invention in which an exclusive property or right is claimed are defined as follows:

1. A system for reporting information comprising:

a plurality of remote stations each connected to at least one sensor and having a synchronization terminal for receiving periodic synchronization signals, a time slot generator connected to synchronization terminal for supplying an enabling signal at a predetermined amount of time after receiving a synchronization signal wherein the time slot for each station occurs at a substantially different time after receipt of a synchronization signal, a data terminal, and a transmit circuit connected to said time slot generator and to said sensor for supplying information derived from said sensor to said data terminal upon receiving said enabling signal;

a master station having a synchonization generator, a synchronization terminal connected to said synchronization generator for receiving synchronization signals therefrom, a data terminal, and information receiving means connected to said data terminal of said master station for receiving said information supplied by said plurality of remote stations; and, communication means interconnecting said data terminals and said synchronization terminals of said master station and said plurality of remote stations.

2. The system of claim 1 wherein said synchronization generator comprises an address generator connected to said information receiving means, said address generator generating addresses to synchronize the information received from each remote station to said information receiving means.

3. The system of claim 2 wherein each remote station comprises a code generator connected to said transmit circuit for encoding said information to be supplied to said master station.

4. The system of claim 3 wherein said master station comprises a code generator connected to said information receiving means for providing a code compatible with the code as supplied by the code generator of said remote station for decoding said information supplied to said master station by said remote stations.

5. The system of claim 4 wherein each remote station has terminal means for connection to plural sensors and said time slot generator comprises means of rcontrolling the transmit circuit so that the information derived from said plural sensors is transmitted within a time slot associated with a remote station and is formed of a plurality of bits in serial form, each bit corresponding to a particular sensor.

6. The system of claim 5 wherein said information receiving means comprises indicating means for displaying said information.

7. The system of claim 6 wherein said indicating means comprises bit display means for displaying the bits of information received from said remote stations and remote station display means for displaying the remote station transmitting the information, said bit display and said remote station display means being connected to said address generator of said master station for synchronizing the bit display means and the remote station display means to the information being received.

8. The system of claim 7 wherein said bit display means comprises at least a first group of indicators for indicating types of alarms and said remote station display means comprises at least a second group of indicators for indicating the remote stations generating said alarms such that said first and second groups of indicators together indicate the type of alarm and the remote station generating the alarm.

9. The system of claim 2 wherein each remote station has terminal means for connection to plural sensors and said time slot generator comprises means for controlling the transmit circuit so that the information derived from said plural sensors is transmitted within a time slot associated with a remote station and is formed of a plurality of bits in serial form, each bit corresponding to a particular sensor.

10. The system of claim 9 wherein said information receiving means comprises indicating means for displaying said information.

11. The system of claim 10 wherein said indicating means comprises bit display means for displaying the bits of information received from said remote stations and remote station display means for displaying the remote station transmitting the information, said bit display and said remote station display means being connected to said address generator of said master station for synchornizing the bit display means and the remote station display means to the information being received.

12. The system of claim 11 wherein said bit display means comprises at least a first group of indicators for indicating types of alarms and said remote station display means comprises at least a second group of indicators for indicating the remote stations generating said alarms such that said first and second groups of indicators together indicate the type of alarm and the remote station generating the alarm.

13. The system of claim 1 wherein each remote station comprises a code generator connected to said transmit circuit for encoding said information to be supplied to said master station.

14. The system of claim 13 wherein said master station comprises a code generator connected to said information receiving means for providing a code compatible with the code as supplied by the code generator of said remote station for decoding said information supplied to said master station by said remote stations.

15. The system of claim 14 wherein each remote station has terminal means for connection to plural sensors and said time slot generator comprises means for controlling the transmit circuit so that the information derived from said plural sensors is transmitted within a time slot associated with a remote station and is formed of a plurality of bits in serial form, each bit corresponding to a particular sensor.

16. The system of claim 15 wherein said information receiving means comprises indicating means for displaying said information.

17. The system of claim 16 wherein said indicating means comprises bit display means for displaying the bits of information receiving from said remote stations and remote station display means for displaying the remote station transmitting the information, said bit display and said remote station display means being connected to said address generator of said master station for synchronizing the bit display means and the remote station display means to the information being received.

18. The system of claim 17 wherein said bit display means comprises at least a first group of indicators for indicating types of alarms and said remote station display means comprises at least a second group of indicators for indicating the remote stations generating said alarms such that said first and second groups of indicators together indicate the type of alarm and the remote station generating the alarm.

19. The system of claim 1 wherein each remote station has terminal means for connection to plural sensors and said time slot generator comprises means for controlling the transmit circuit so that the information derived from said plural sensors is transmitted within a time slot associated with a remote station and is formed of a plurality of bits in serial form, each bit corresponding to a particular sensor.

20. The system of claim 19 wherein said information receiving means comprises indicating means for displaying said information.

21. The system of claim 20 wherein said indicating means comprises bit display means for displaying the bits of information received from said remote stations and remote station display means for displaying the remote station transmitting the information, said bit display and said remote station display means being connected to said address generator of said master station for synchronizing the bit display means and the remote station display means to the information being received.

22. The system of claim 21 wherein said bit display means comprises at least a first group of indicators for indicating types of alarms and said remote station display means comprises at least a second group of indicators for indicating the remote stations generating said alarms such that said first and second groups of indicators together indicate the type of alarm and the remote station generating the alarm.

23. The system of claim 1 wherein said information receiving means comprises indicating means for displaying said information.

24. The system of claim 23 wherein said indicating means comprises bit display means for displaying bits of information received from said remote stations and remote station display means for displaying the remote station transmitting the information, said bit display and said remote station display means being connected to said address generator of said master station for synchronizing the bit display means and the remote station display means to the information being received.

25. The system of claim 24 wherein said bit display means comprises at least a first group of indicators for indicating types of alarms and said remote station display means comprises at least a second group of indicators for indicating the remote stations generating said alarms such that said first and second groups of indicators together indicate the type of alarm and the remote station generating the alarm.

26. A system for reporting alarm information comprising:

a plurality of remote stations each connected to a plurality of alarm sensors and having a synchronization terminal for receiving periodic synchronization signals, a time slot generator connected to said synchronization terminal for supplying an enabling signal at a predetermined amount of time after receiving a synchronization signal wherein the time slot for each station occurs at a substantially different time after receipt of a synchronization signal, a data terminal, and a transmit circuit connected to said time slot generator and to each alarm sensor associated with said remote station for supplying a plurality of alarm bits, each bit corresponding to an alarm sensor, in serial form to said data terminal upon receiving said enabling signal;

a master station having a synchronization generator for supplying both synchronization signals and address signals, a synchronization terminal connected to said synchronization generator for receiving said synchronization signals, a data terminal, and indicating means connected to said data terminal of said master station and to said signal generator for receiving the addresses thereof for displaying said bits of alarm information supplied by said plurality of remote stations and said remote station identification, said addresses synchronizing said indicating means to said information received from said remote stations; and, communication means interconnecting said data terminals and said synchronization terminal of said master station and said pluralunication means interconnecting said data terminals and said synchronization terminal of said master station and said plurality of remote stations.

27. The system of claim 26 wherein each remote station comprises a code generator connected to said transmit circuit for encoding said information to be supplied to said master station.

28. The system of claim 27 wherein said master station comprises a code generator connected to said indicating means for providing the same code as the code generator with respect to said remote station for decoding said information supplied to said master station by said remote stations.

* * * * *